United States Patent [19]

McCormick

[11] 4,324,176

[45] Apr. 13, 1982

[54] TOW BALING

[75] Inventor: Robert M. McCormick, Columbia, S.C.

[73] Assignee: E. I. Du Pont de Nemours and Company, Wilmington, Del.

[21] Appl. No.: 119,376

[22] Filed: Feb. 7, 1980

[51] Int. Cl.[3] ..... B65B 13/06

[52] U.S. Cl. ..... 100/3; 100/7; 100/25; 100/80; 100/229 R; 100/247

[58] Field of Search ..... 100/3, 7, 8, 25, 26, 100/80, 81, 229 R, 247, 252; 53/116, 418, 436

[56] References Cited

U.S. PATENT DOCUMENTS

| | | | |
|---|---|---|---|
| 150,818 | 5/1874 | Brown | 100/25 X |
| 502,192 | 7/1893 | Ivens | 100/80 X |
| 622,161 | 3/1899 | Patterson | 100/80 X |
| 2,423,209 | 7/1947 | Storey | 100/247 X |
| 2,757,603 | 8/1956 | Wilson | 100/252 |
| 3,120,893 | 2/1964 | Guenther | 206/83.5 |
| 3,463,079 | 8/1969 | Corbett | 100/229 R |
| 3,728,959 | 4/1973 | Fredrickson | 100/3 |
| 3,739,546 | 6/1973 | O'Neill | 53/116 |
| 3,846,955 | 11/1974 | Mattis | 53/436 |
| 3,994,116 | 11/1976 | McCormick | 53/418 |

FOREIGN PATENT DOCUMENTS

| | | | |
|---|---|---|---|
| 220130 | 9/1968 | U.S.S.R. | 100/229 R |

*Primary Examiner*—Billy J. Wilhite

[57] ABSTRACT

Process for packing of tow utilizes a movable container with self contained strapping guides as a baling chamber. The filled container is moved into position under a ram to compress the product to a set height. After compression one side of the container is opened permitting an automatic strapper to strap the bale and after strapping the bale is ejected from the container which returns to a filling station and the cycle is repeated.

1 Claim, 3 Drawing Figures

TOW BALING

BACKGROUND OF THE INVENTION

This invention relates to an apparatus for packaging tow and more particularly to a novel container useful in a process for preparing a nude-strapped bale of tow.

Synthetic fibers are frequently produced in the form of a tow which contains a large number of individual continuous filaments arranged in a single strand or rope. There are a number of well known methods for packaging tow. In one such method tow is fed through a spout which reciprocates back and forth in one or more planes. The tow is laid in a carton then compressed after the carton has become filled and the carton is closed to retain the compressed tow.

In some instances it is desirable to eliminate the carton and package the tow as nude-strapped bales. However, the only equipment available for doing this is high compression balers which have compression capacities far in excess of those needed for the lower densities required to compress the tow into bales used as substitutes for carton-packed tow. It has now been found that compression to lower densities can now be accomplished in an apparatus which is substantially less expensive than high-compression balers.

SUMMARY OF THE INVENTION

The above-noted problems are largely overcome in a process for preparing nude-strapped bales of tow comprising depositing tow in a portable flat-sided container having an opening at its top to accept the tow. The container has a sliding door on one side to expose the deposited tow and aligned strapping guides are formed in the bottom and in the side opposite the sliding door of the container. After being filled with tow the container is moved under a ram which has strapping guides formed in its lower surface that contacts the tow. Next the ram is lowered to compress and stabilize the tow; then the sliding door is lifted to expose the compressed tow to strapping equipment which automatically straps the tow. The ram is raised from the container and the strapped tow bale is ejected from the container.

DETAILED DESCRIPTION OF THE ILLUSTRATED EMBODIMENT

Figure 1:
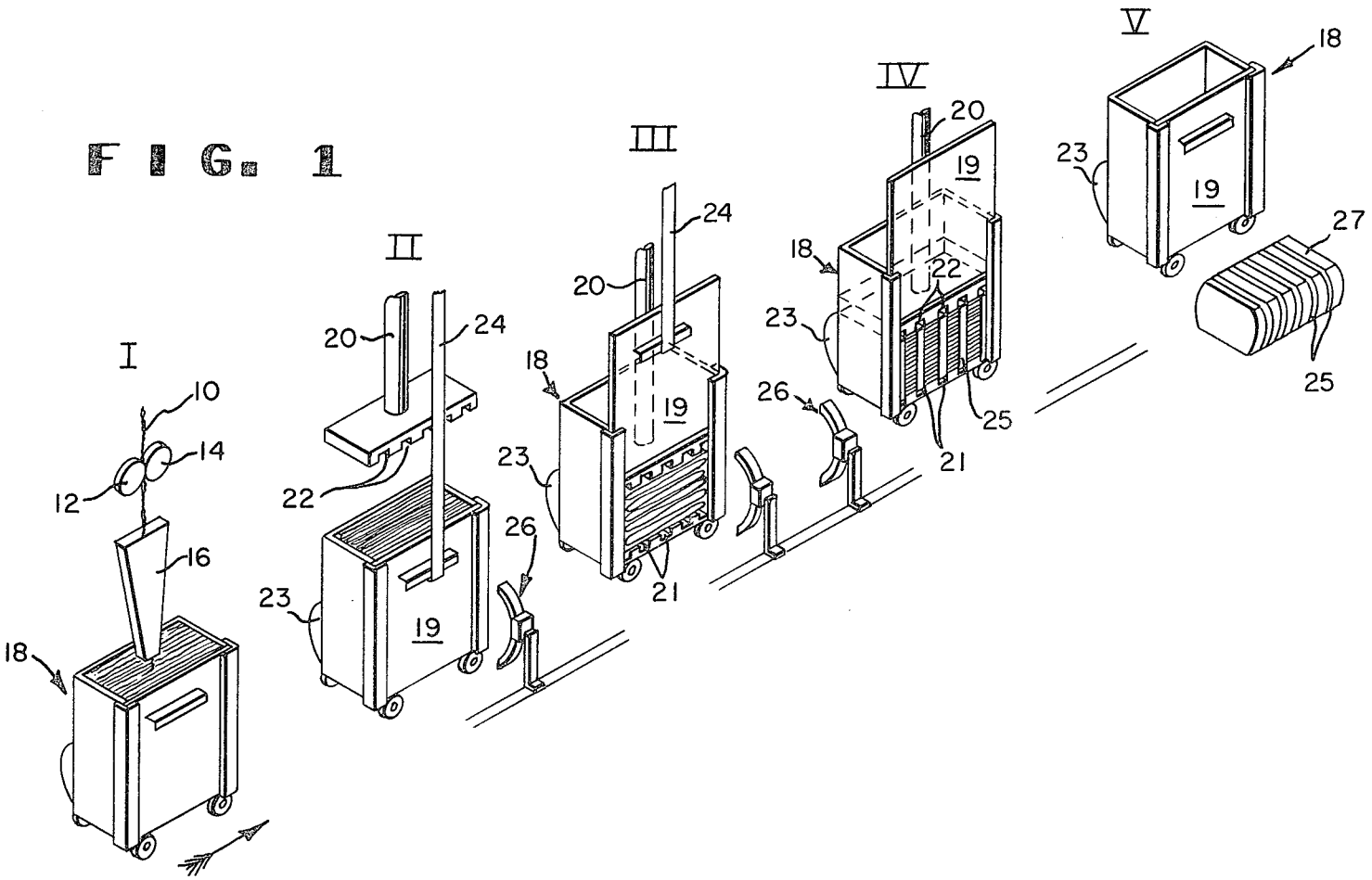
FIG. 1 is a schematic view illustrative of the process steps involved in forming the nude-strapped bale.
Figure 2:
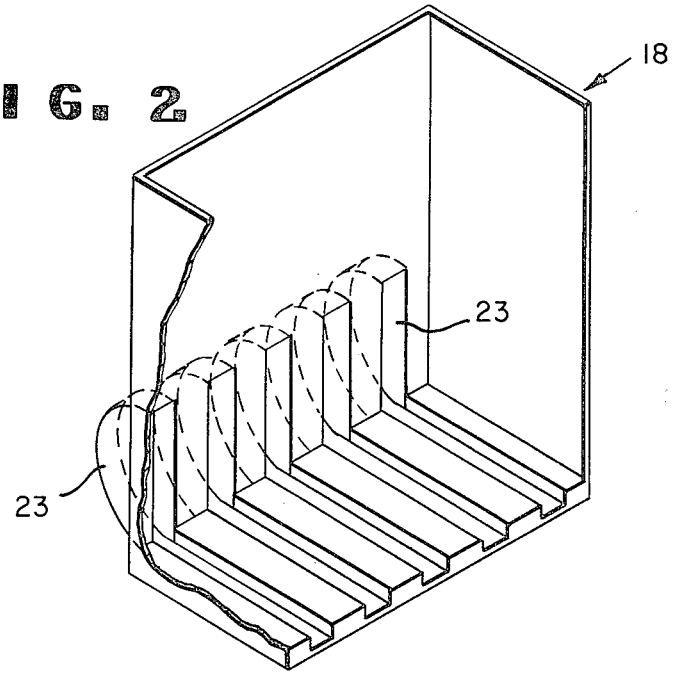
FIGS. 2 and 3 are front and rear perspective views of the container used in the process of forming a nude-strapped bale according to this invention.
Figure 3:
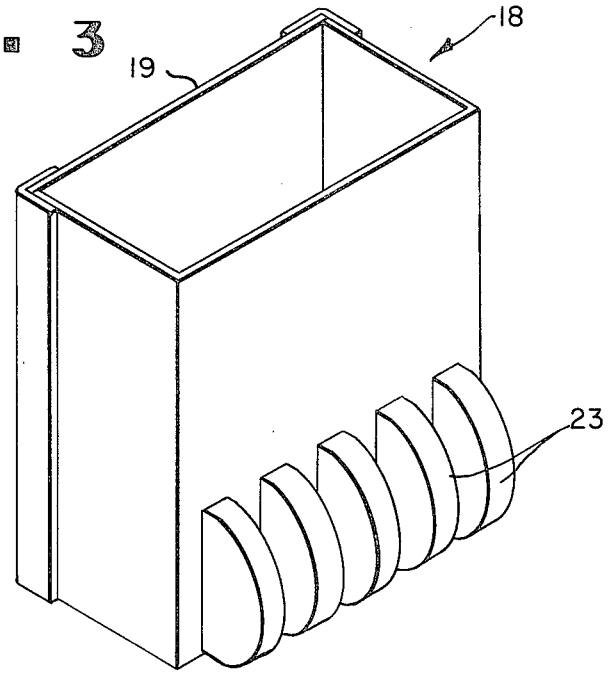

With reference to FIGS. 1 to 3 tow 10 is withdrawn from a source by a pair of pull rolls 12, 14. After leaving the pull rolls, tow 10 drops from piddler spout 16 into wheeled open-top container 18. Piddler spout 16 is driven by means (not shown) to distribute the tow into container 18. The amount of tow that is fed into the container is metered either according to weight or according to length, which in turn depends on the feed speed and time. When sufficient tow has been metered into the container it generally comes approximately to the top of the container; the tow feed is stopped and container 18 is moved underneath ram 20 which has strapping guides 22 formed in its bottom or lower surface. The container 18 has a sliding door 19 on one side which can be raised by extensible member 24 to expose the compressed tow. In front of the container is a strapping machine 26 which can be movably aligned with strapping guides 22 in the ram and guides 21 and 23 in the container to place bands 25 around the compressed tow to form bale 27 which is shown ejected from the container 18.

In operation (FIG. 1) an empty container is moved to a tow filling station (I) and tow 10 is fed into the container 18 until it is nearly full, then the container is moved to a pressing station (II) underneath ram 20. The ram 20 compresses the tow so that it fits in the container 18 and so that guides 22 are in alignment with guides 23 in the side opposite the sliding door 19 of the container. Then with the ram 20 holding the tow in the pressed condition, door 19 is lifted by member 24 to expose the compressed tow. Strapping machine 26 is then moved into position aligned with strapping guides 21, 22 and 23 and the bale is strapped (III, IV). After the bale is strapped, the ram 20 is raised and the bale is ejected from the container; the door 19 is closed and the container is then ready to return to the filling station (V). The nude-strapped bale may then be wrapped for shipment according to U.S. Pat. No. 3,994,116.

1. A process for preparing a nude-strapped bale of tow comprising: depositing said tow in a portable flat-sided container having an opening at its top to accept the tow, said container having a sliding door in one side to expose the deposited tow, there being aligned strapping guides on the bottom and the side opposite the sliding door of the container; moving said container underneath a ram, said ram having strapping guides in its bottom surface; lowering said ram through the opening in said container to compress and stabilize said tow in one stroke; compressing said tow with said ram by moving said ram downward to a location where the strapping guides on the ram's surface align with the strapping guides on the side of the container; lifting said sliding door to expose said tow; strapping said compressed tow; raising said ram out from said container; ejecting the strapped bale of tow and moving said container to another location out from under the ram.

* * * * *